United States Patent [19]

Rosenberg

[11] Patent Number: 4,583,689

[45] Date of Patent: Apr. 22, 1986

[54] ROTARY SPRINKLER

[76] Inventor: Peretz Rosenberg, Moshav Beit Shearim, Israel

[21] Appl. No.: 631,760

[22] Filed: Jul. 17, 1984

[30] Foreign Application Priority Data

| | | | |
|---|---|---|---|
| Jul. 22, 1983 | [IL] | Israel | 69302 |
| Jan. 20, 1984 | [IL] | Israel | 70739 |
| Jun. 19, 1984 | [IL] | Israel | 72147 |
| Jun. 29, 1984 | [IL] | Israel | 72262 |

[51] Int. Cl.[4] ..... B05B 3/04; B05B 3/16

[52] U.S. Cl. ..... 239/381

[58] Field of Search ..... 239/380, 381, 383, 453, 239/454, 461, 506, 507, 222.11, 222.17, DIG. 16

[56] References Cited

U.S. PATENT DOCUMENTS

| | | | |
|---|---|---|---|
| 1,307,514 | 3/1918 | Patterson | 239/383 |
| 2,408,196 | 9/1946 | Carlson | 239/383 X |
| 3,006,558 | 10/1961 | Jacobs | 239/222.17 X |
| 3,877,644 | 4/1975 | Cockman | 239/383 X |
| 4,261,515 | 4/1981 | Rosenberg et al. | 239/381 X |
| 4,331,294 | 5/1982 | Gilad | 239/454 X |

FOREIGN PATENT DOCUMENTS

| | | | |
|---|---|---|---|
| 103160 | 10/1962 | Netherlands | 239/383 |

*Primary Examiner*—Andres Kashnikow
*Assistant Examiner*—David P. Davidson
*Attorney, Agent, or Firm*—Benjamin J. Barish

[57] ABSTRACT

Rotary sprinklers are described comprising a nozzle having an axial bore for forming an axial jet, and a rotor floatingly mounted for axial and rotary movement, the underface of the rotor being formed with a pair of grooves from its center to its outer edge for deflecting the axial jets laterally of the sprinkler and for imparting a rotary motion to the rotor. The rotor further includes a stem depending from its underface and received within the nozzle bore, which stem is formed with a pair of grooves extending axially thereof and merging with the radially-extending grooves in the underface of the rotor. Also described are various arrangements for floatingly mounting the rotor by means of a spindle, a cap, or a bridge.

16 Claims, 19 Drawing Figures

FIG.1
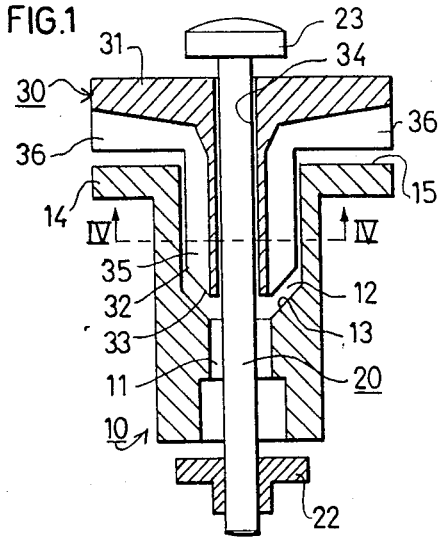
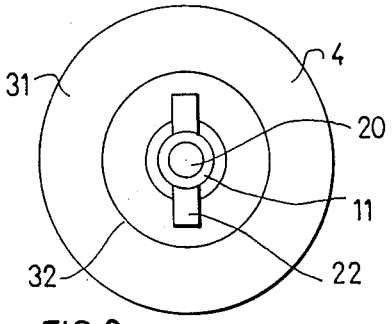
FIG. 2
FIG. 3
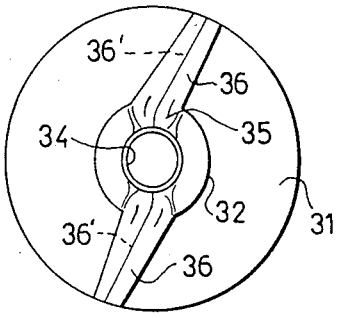
FIG.4
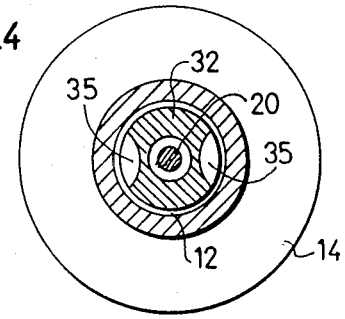
FIG.6
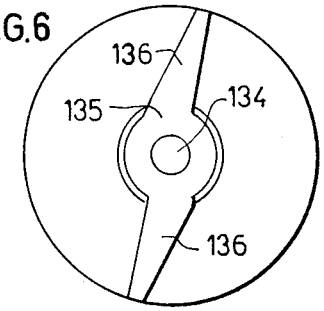
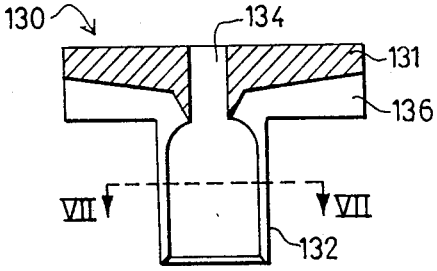
FIG 5
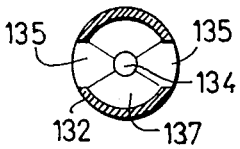
FIG.7

FIG. 8
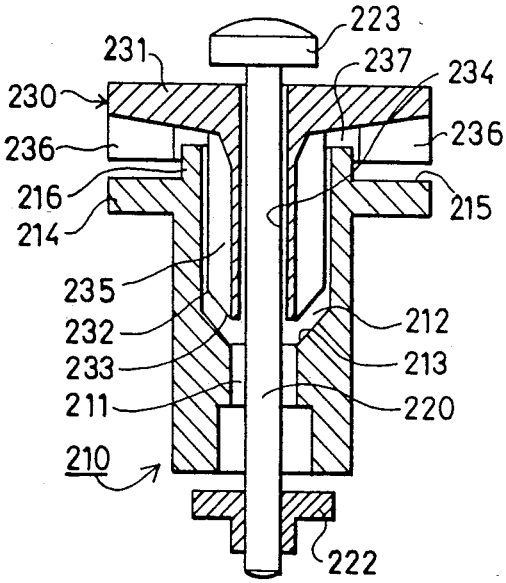
FIG. 10
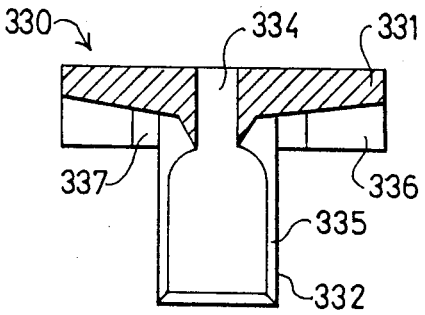
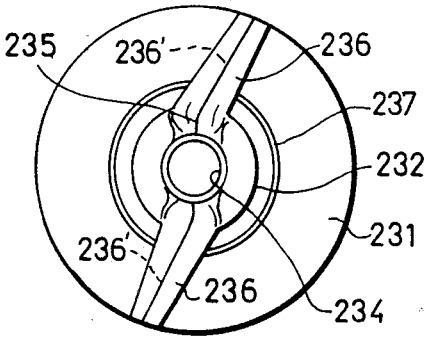
FIG. 9
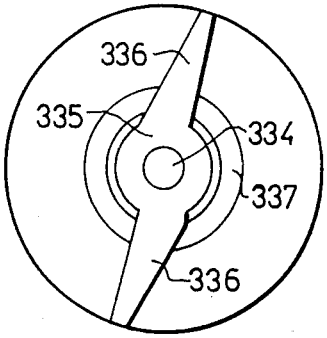
FIG 11

FIG. 12
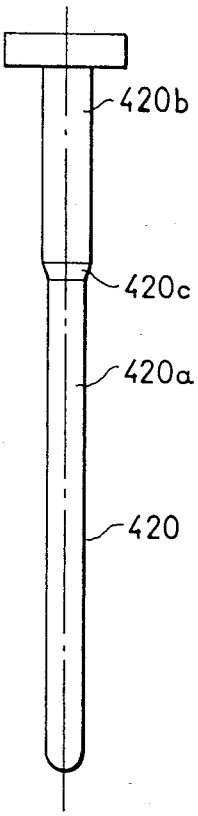
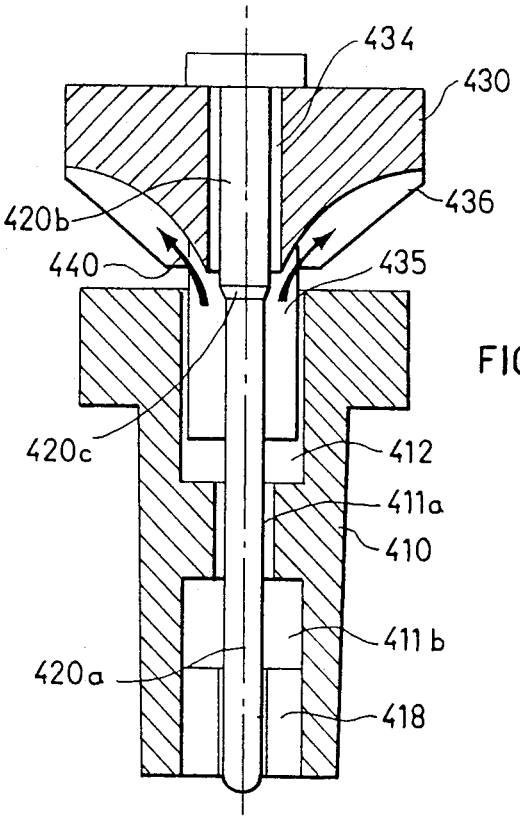
FIG. 13
FIG. 14
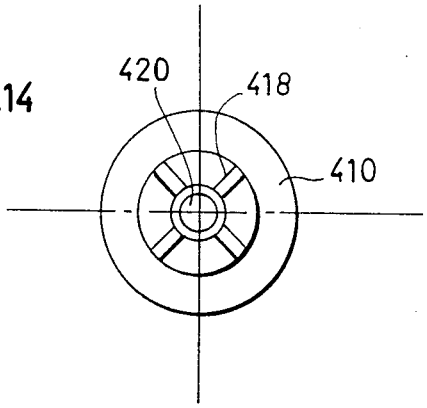

ROTARY SPRINKLER

BACKGROUND OF THE INVENTION

The present invention relates to rotary sprinklers, and is particularly directed to an improvement to the type of rotary sprinkler described in U.S. Pat. No. 4,261,515.

The above Application describes a rotary sprinkler comprising a nozzle having an inlet connectable to a source of pressurized water and formed with an axial bore through which the water exits in the form of an axial jet, a rotor in the path of the axial jet, and means for floatingly mounting the rotor for axial, lateral and rotary movements with respect to the nozzle bore, the underface of the rotor being formed with at least one groove (preferably two) extending from the rotor center to its outer edge for deflecting the jet laterally of the sprinkler and for imparting a rotory motion to the rotor.

BRIEF SUMMARY OF THE INVENTION

The present invention is directed to a rotary sprinkler of the foregoing type but having an improved construction providing a number of important advantages as will be more particularly described below.

According to a broad aspect of the present invention, there is provided a rotary sprinkler of the foregoing type including the following features: the exit end of the nozzle bore is of enlarged diameter to define a cylindrical socket: the rotor includes a stem depending from its underface and floatingly received within the socket; the rotor stem has an outer diameter slightly less than the inner diameter of the socket for axial, lateral and rotary movement therein; and the rotor stem is formed with at least one groove extending axially thereof and merging with the groove formed in the underface of the rotor.

According to further aspects of the invention, as described below, the means for floatingly mounting the rotor may be in the form of a spindle, a cap, or a bridge.

Rotary sprinklers constructed in accordance with the foregoing features provide a number of important advantages: Thus, this novel construction provides a longer path in which the water issued from the sprinkler is constrained in jet form, which longer path substantially decreases the divergence of the water in the jet, and thereby substantially increases the range of the sprinkler. The novel construction also decreases the friction of the rotor, lowers the sensitivity of the sprinkler to clogging, and better self-cleans itself of dirt particle, all of which enable the sprinkler to be used with a lower line pressure for a given range; and further, it more effectively closes the nozzle bore against the entry of dirt, insects, or the like, during the long periods when the sprinkler is not in use.

All the foregoing advantages are, of course, additional to the advantages provided by this type of rotary sprinkler as described in the above-cited patent specification, including uniformity in the distribution of the water laterally of the sprinkler, self-cleaning capability, reduced friction, and non-criticality in the dimensioning of parts permitting low-cost manufacture and assembly.

Further features of the invention will be apparent from the description below.

BRIEF DESCRIPTION OF THE DRAWINGS

The invention is herein-described, by way of example only, with reference to the accompanying drawings, wherein:

FIG. 1 is a longitudinal sectional view illustrating one form of rotary sprinkler constructed in accordance with the present invention;

FIG. 2 is a bottom plan view of the sprinkler of FIG. 1;

FIG. 3 is a bottom plan view only of the rotor in the sprinkler of FIG. 1;

FIG. 4 is a transverse sectional view along lines IV—IV of FIG. 1;

FIG. 5 is a longitudinal sectional view of a modified rotor that may be used in the sprinkler of FIG. 1;

FIG. 6 is a bottom view of the rotor of FIG. 5;

FIG. 7 is a transverse sectional view along lines VII—VII of FIG. 5;

FIGS. 8 and 9 are views, corresponding to FIGS. 1 and 3, respectively, of a modified sprinkler;

FIGS. 10 and 11 are longitudinal-sectional and bottom-plan views, respectively, of a modified rotor;

FIG. 12 is a side view of a modified spindle;

FIGS. 13 and 14 are longitudinal-sectional and bottom-plan views, respectively, illustrating a sprinkler including the modified spindle of FIG. 12;

DESCRIPTION OF PREFERRED EMBODIMENTS

Figure 15:
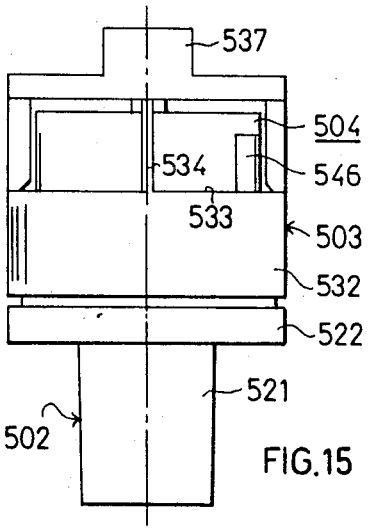
FIG. 15 is a side view of another sprinkler in accordance with the present invention.

The rotary sprinkler illustrated in FIGS. 1–4 is of the general construction as that illustrated in the above-cited patent specification. It comprises three main parts; namely: a nozzle 10 connectable to the liquid supply pipe and having an axial bore 11 for issuing the liquid in the form of a jet; a spindle 20 of smaller diameter than the nozzle bore; and a rotor 30 floatingly mounted on the spindle for rotary and axial movement. Spindle 20 includes an inner stop 22 for limiting the axial movement of the spindle in nozzle bore 11, and an outer stop 23 for limiting the axial movement of the rotor 30 with respect to the spindle.

The sprinkler illustrated in FIGS. 1–4, however, includes the following modifications in the structure over that of the above-cited patent specification, both in the nozzle 10 and in the rotor 30.

With respect to nozzle 10, it will be seen from FIG. 1 that the diameter of bore 11 through the nozzle is enlarged on the side of the nozzle facing the rotor 30, to define a socket 12 coaxial with nozzle bore 11. The juncture between socket 12 and nozzle bore 11 is tapered, as shown at 13. In addition, the outer end of nozzle 10 facing rotor 30 is formed with an enlarged head 14 having a flat surface 15.

Rotor 30 is constituted of two integrally-formed sections; namely, an outer head 31 and a depending stem 32. Stem 32 is rotatably received within nozzle socket 12, and its lower end is tapered as shown at 33, corresponding to the tapered bottom wall 13 of the nozzle socket. Stem 32 is of solid cylindrical configuration, having an outer diameter slightly less than the inner diameter of socket 12. Rotor 30 is formed with an axial bore 34 extending through its stem 32 and its head 31, which bore is of slightly larger diameter than the outer diameter of spindle 20.

Rotor stem 32 is further formed with two axially-extending grooves 35 on opposite sides of its bore 34. These grooves 35 communicate at their lower ends with the nozzle bore 11, and at their upper ends with additional grooves 36 formed in the underface of rotor head 31, and extending in a generally radial direction to the outer end of the rotor head. As shown particularly in FIG. 3, the axes 36' of the latter grooves 36 are eccentric to the longitudinal axis of the rotor 30, being substantially tangential to bore 34 formed through the rotor, such that the water flowing through grooves 36 from grooves 35 imparts a rotary motion to the rotor.

Basically, the rotary sprinkler illustrated in FIGS. 1–4 operates substantially in the same manner as in the above-cited patent specification. Thus, when the water supply is turned off, rotor 30 drops by gravity onto the nozzle face 15, whereby the rotor, particularly its stem 32, effectively closes the nozzle bore 11 and socket 12 against the entry of dirt, insects, or other particles during the non-use of the sprinkler. The modified construction of the rotor and nozzle in the present invention, however, provides a better and more positive closure of the nozzle bore, which is particularly desirable when the sprinkler is left in the field for long periods of non-use.

When the water supply is turned on, the water passes from the inlet of nozzle 10 through nozzle bore 11, into the nozzle socket 12, through the axially-extending grooves 35 in the rotor stem 32, and then through the radially-extending grooves 36 in the underface of the nozzle head 31. Nozzle bore 11 causes the water to issue therefrom in the form of an annularly-configured jet, and grooves 35 divide the jet into two jets which are constrained to flow, first axially of the rotor through grooves 35, and then radially of the rotor through grooves 36, such that the water issues from the sprinkler in the form of two diametrically-opposed well-defined jets. Since the axes of the two grooves 36 are eccentric to the rotor, these two jets impart a rotary motion to the rotor, so that the two jets are rotated to produce a substantially uniform distribution of the water 360° around the sprinkler.

As in the rotary sprinkler of the above-cited patent specification, the rotor 30 floats, also axially and laterally, within the nozzle 10, such that the spindle and the rotor self-center themselves in their respective bores. Such an arrangement thereby provides low-friction movement of these elements, low-sensitivity to clogging the sprinkler, and self-cleaning characteristics.

It has been found, however, that the above-described modifications in the structure of the nozzle 10 and the rotor 30 provide important additional advantages. Thus, the grooves 35 and 36 formed in the rotor 30 act to constrain the water in jet form for a substantially longer period of time, and therefore better confine (i.e., decrease the divergence of) the jets issuing from the sprinkler; this substantially increases the range of the sprinkler over that of the earlier sprinkler construction. In addition, by this increase in range, the water sprinkler is capable of being used, for any given range, with a lower supply pressure than possible with the earlier sprinkler construction.

FIGS. 5–7 illustrate a modified construction in the rotor, therein designated 130. In this modified rotor construction, its stem 132 is of hollow cylindrical configuration, rather than of solid cylindrical configuration, as in the FIGS. 1–4 embodiment.

Thus, stem 132 is also formed with the axial bore 134 for accommodating the spindle (20 in FIG. 1), and with the two axially-extending grooves 134 communicating at one end with the nozzle bore (11 in FIG. 1), and at the opposite end with the radially-extending grooves 136 formed in the underface of the nozzle head 131. The hollow construction of nozzle stem 132 defines an inner cavity 137 within the stem. This decreases the overall weight of the rotor, and thereby further decreases the line pressure required for operation of the sprinkler. In all other respects, , the construction and operation of the sprinkler including the modified rotor of FIGS. 5–7 are the same as described above with respect to FIGS. 1–4.

The sprinkler illustrated in FIGS. 8 and 9 also comprises three main parts; namely: a nozzle 210 connectable to the liquid supply pipe and having an axial bore 211 for issuing the liquid in the form of a jet; a spindle 220 of smaller diameter than the nozzle bore 211; and a rotor 230 floatingly mounted on the spindle for rotary and axial movement. Spindle 220 includes an inner stop 222 for limiting the axial movement of the spindle in nozzle bore 211 and an outer stop 223 for limiting the axial movement of the rotor 230 with respect to the spindle.

As in FIGS. 1–4, the diameter of bore 211 through nozzle 210 is enlarged on the side of the nozzle facing the rotor 230, to define a socket 212 coaxial with the nozzle bore. The juncture 213 between socket 212 and nozzle bore 211 is tapered. In addition, the outer end of nozzle 216 facing rotor 230 is formed with an enlarged head 214 having a flat surface 215.

In FIGS. 8 and 9, however, nozzle 210 is formed with an annular rib 216 contiguous to the upper end of socket 212 and projecting outwardly from the upper flat face of the enlarged head 214. Annular rib 216 cooperates with an annular recess, as will be described more fully below, for blocking the entry of foreign matter which may clog the sprinkler, particularly during long periods of non-use.

As in FIGS. 1–4, rotor 230 is constituted of two integrally-formed sections; namely, an outer head 231 and a depending stem 232. Stem 232 is rotatably received within nozzle socket 212, and its lower end 233 is tapered, corresponding to the tapered bottom wall 213 of the nozzle socket. Rotor stem 232 is of solid cylindrical configuration having an outer diameter slightly less than the inner diameter of socket 212. Rotor 230 is formed with an axial bore 234 extending through its stem 232 and its head 231, which bore is of slightly larger diameter than the outer diameter of spindle 220.

Rotor stem 232 is also further formed with two axially-extending grooves 235 on opposite sides of its bore 234. These grooves 235 communicate at their lower ends with the nozzle bore 211, and at their upper ends with additional grooves 236 formed in the underface of rotor head 231, and extending in a generally radial direction from the center to the outer edge of the rotor head. As shown particularly in FIG. 9, the axes 236' of the latter grooves 236 are eccentric to the longitudinal axis of the rotor 230, being substantially tangential to bore 234 formed through the rotor, such that the water flowing through grooves 236 from grooves 235 imparts a rotary motion to the rotor.

In addition, the underface of rotor 230 is formed with an annular recess 237 at the juncture between groove 235 extending axially of stem 232, and grooves 236 formed in the underface of rotor 230. Annular recess 237 is of a width and depth such as to accommodate annular rib 216 formed in the upper face of nozzle 210 when the sprinkler is not operating.

The rotary sprinkler illustrated in FIGS. 8 and 9 operates substantially in the same manner as in FIGS. 1–4. Thus, when the water supply is turned off, rotor 230 drops by gravity onto the nozzle face 215. When this occurs, the annular rib 216 formed around socket 232 of the nozzle is received within the annular recess 237 formed in the underface of the rotor 230, closing the nozzle bore 211 and socket 212 against the entry of dirt, insects, or other particles during the non-use of the sprinkler. This modified construction of the rotor and nozzle provides a very effective and positive closure of the nozzle bore, which is particularly desirable when the sprinkler is left in the field for long periods of non-use.

FIGS. 10 and 11 illustrate a modified construction in the rotor, therein designated 330. In this modified rotor construction, its stem 332 is of hollow cylindrical configuration, rather than of solid configuration as in the FIGS. 8 and 9 embodiment.

Thus, stem 332 is also formed with the axial bore 334 for accommodating the spindle (220 in FIG. 8), and with the two axially-extending grooves 335 communicating at one end with the nozzle bore (311 in FIG. 8), and at the opposite end with the radially-extending grooves 336 formed in the underface of the nozzle head 331. The hollow construction of nozzle stem 332 defines an inner cavity 337 within the stem, which decreases the overall weight of the rotor, and thereby further decreases the line pressure required for operation of the sprinkler.

As in the embodiment of FIGS. 8 and 9, the rotor 330 in FIGS. 10 and 11 is also formed with an annular recess 337 at the juncture between the axially-extending recesses through the spindle 332, and the radially-extending recesses 336 in the underface of the rotor 330. Annular recess 337 is to receive the annular rib formed in the upper face of the nozzle (annular rib 216 in FIGS. 8 and 9) in order to block the entry of foreign matter particularly during long periods of non-use.

FIGS. 12–14 illustrate another modification, wherein the spindle 420 is formed of a lower section 420*a* of smaller diameter than its upper section 420*b*, the two sections being joined by a juncture 420*c* which is preferably, but not necessarily, tapered as shown particularly in FIG. 12; In addition, the bore through the nozzle 410 is reduced in diameter at 411*a* (FIG. 13) to accommodate spindle section 420*a*, the lower end 411*b* of the bore being of increased diameter but including a plurality of radially-extending circumferentially-spaced ribs 418 for guiding the movement of the spindle. Further, the underface of the rotor 430 is formed with a plurality of axially-extending, circumferentially-spaced ribs 435 received within socket 412 of the nozzle, these ribs thereby defining the axially-extending grooves merging with the radially-extending grooves 436 found in the underface of the rotor 430.

The juncture 420*c* between the two sections 420*a*, 420*b* of the spindle deflects the water as shown by the arrows 440, thereby preventing the water, and any dirt particles carried in the water, from entering bore 434 between the upper section 420*b* of the spindle and the rotor 430. Accordingly, bore 434 may be of substantially larger diameter than the upper section 420*b* of the spindle, further decreasing the possibility of clogging. The possibility of clogging is even further decreased by the arrangement including the ribs 418 in the nozzle 410, and the ribs 435 in the rotor 430.

Figure 16:
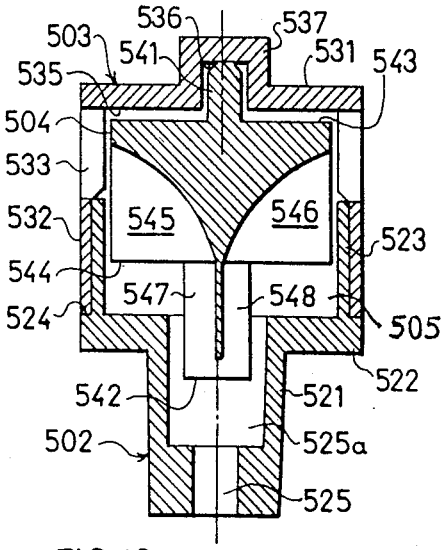
FIG. 16 is a longitudinal sectional view of the sprinkler of FIG. 15, with the rotor in its active position.
Figure 17:
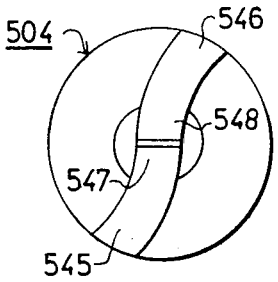
FIG. 17 is a bottom view of the rotor in the sprinkler of FIGS. 15 and 16.

FIGS. 15–17 illustrate another form of sprinkler wherein the floating mounting for the rotor is effected by means of a cap, rather than a spindle. This sprinkler also includes three main parts, namely a nozzle 502, a cap 503, and a rotor 504. Briefly, the nozzle 502 is adapted to be connected to a pressurized source of water and forms an axial jet; the cap 503 defines an internal chamber 505 with nozzle 502; and the rotor 504 is freely disposed within chamber 505 in position so as to receive the axial jets from nozzle 502 and to deflect same through outlet openings formed in the cap while the jet rotates the rotor.

More particularly, nozzle 502 is constituted of a cylindrical body 521 for frictional insertion within a cylindrical bore formed in a water supply pipe. The end of body section 521 opposite to that inserted into the water supply pipe is formed with a radially extending wall section 522 of larger diameter than body section 521, and with an axially-extending wall section 523 of slightly smaller outer diameter than that of wall section 522 so as to define an annular step 524 around wall section 522. Sections 521, 522, and 523 of the nozzle are all of circular cross-section and may be integrally formed together, as by injection molding.

Nozzle 502 is further formed with an axially-extending bore 525 centrally through the body section 521, the upper end of bore 525 being enlarged, defining a socket as shown at 525*a*, accommodating the rotor 504, as to be described below.

Cap 503 includes a top wall 531 and a peripheral side wall 532 received, by a friction fit, in step 524 around axial wall 523 of the nozzle. Thus, side wall 532 of cap 503 is also of circular cross-section and has an inner diameter substantially equal to the outer diameter of nozzle wall 523, and an outer diameter substantially equal to the outer diameter of nozzle wall 522 so as to be flush with the latter wall.

The upper portion of cap side wall 532 is formed with a plurality of water outlet openings or windows 533 spaced circumferentially around the cap side wall and separated by narrow bridges 534 (FIG. 15). In the sprinkler illustrated in the drawings, there are four of such outlet openings 533. The height of each outlet opening 533 (i.e., its dimension axially of the sprinkler) is preferably less than one-half the height of the cap side wall 532.

The inner face of the cap top wall 531 is flat, as shown at 535, but is formed with a central recess 536 in a projecting stem 537 for receiving the rotor 504 as will be descibed below.

Rotor 504, as described earlier, is freely disposed within chamber 505 defined by nozzle 502 and cap 503. Rotor 504 is formed with an upper stem 541 received within recess 536 of the cap, and with a lower stem 542 received within socket 525*a* at the exit end of the nozzle bore 525. Rotor 504, its upper stem 541, and its lower stem 542, are all of circular cross-section and of a diameter slightly less than their respective receptors, namely chambers 505 for the rotor, recess 536 for its upper stem 541, and socket 525*a* for its lower stem 542, so as to permit free rotary and axial movement of the rotor within chamber 505.

The upper face 543 of rotor 504 is flat, except for its upper stem 541, conforming to the flat inner face 535 of the cap top wall 531. The underface of rotor 504 is similarly flat, as shown at 544, to conform to the flat upper face of nozzle wall section 522. This underface of the rotor is formed with a pair of diametrically-opposed, upwardly-curved grooves 545, 546, starting centrally of the underface of the rotor and extending to its outer edge just below its flat top wall 543. Grooves 545 and 546 merge with a pair of further grooves 547 and 548 formed axially in the lower stem 542 of the rotor on diametrically-opposed sides thereof.

Grooves 547, 548, formed axially of the lower stem 542, merge just above the lower tip of that stem so that the pressurized water entering nozzle bore 525 is divided to form two jets in the two grooves 547, 548. The latter grooves direct these jets to grooves 545, 546 formed in the underface of rotor 504, which grooves direct the jets laterally through outlet openings 533 of the cap side walls 532, while at the same time impart a rotary motion to the rotor.

In order to assemble the sprinkler, it is only necessary to drop the lower stem 542 of rotor 504 into socket 525*a* of the nozzle bore 525, and then to apply side walls 532 of cap 503 with a friction fit over the outer face of the nozzle side wall 523. When the sprinkler is not in operation, lower stem 542 rests within socket 525*a* of the nozzle bore 525, and the upper stem 541 of the rotor is received within, but spaced from, recess 536 of the cap top wall 531. In this non-operating condition of the sprinkler, the upper ends of the rotor grooves 545, 546 are below the lower ends of the outlet openings 533, thereby substantially shielding grooves 545 and 546, as well as bore 525 and its socket 525*a*, from the entry of foreign matter.

When the sprinkler is operated, the pressurized water is formed by bore 525 into a jet which flows axially within socket 525*a* and is divided by grooves 547, 548 of the rotor lower stem 542 into two axially flowing jets. These axially flowing jets cause rotor 504 to rise within chamber 505, limited by the rotor upper stem 541 received within recess 536 of the cap top walls 531, so as to raise the outlet ends of grooves 545, 546, formed in the underface of rotor 504, to the level of the outlet openings 533 in the cap side wall 532. In addition, these shaped grooves 545, 546 direct the jets from their original axially-flowing direction to a radial direction through the outlet openings 533, while the curvature of these grooves, as shown in FIG. 17, imparts a rotary motion to the rotor.

It will thus be seen that cap 503 substantially protects the sprinkler against the entry of foreign matter which may tend to clog rotor 504 or the nozzle bore 525. In addition, the illustrated three parts may be produced in volume and at low cost; may be simply assembled and disassembled for maintenance, repair or replacement purposes; and provide a sprinkler of substantially large passageways having a low sensitivity to clogging. In this respect, the outlet openings 533 in the cap side wall 532 may be lowered so as to be be below the upper ungrooved portion of the rotor 504 in the non-operative condition of the sprinkler, thereby further reducing the possibility of entry of foreseen particles.

Figure 18:
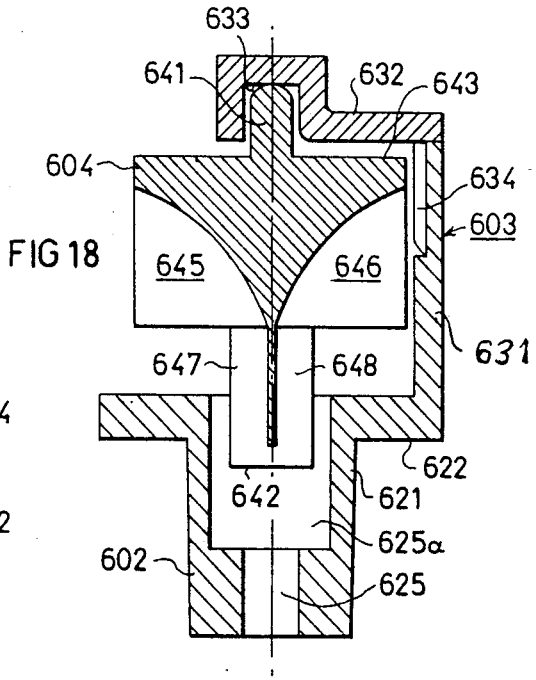
FIGS. 18 and 19 are longitudinal-sectional and top plan views, respectively, of another sprinkler in accordance with the present invention.
Figure 19:
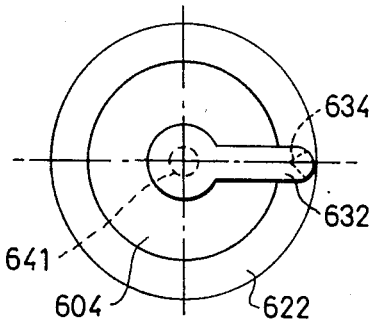

FIGS. 18 and 19 illustrate a further form of rotary sprinkler wherein the floating mounting of the rotor, therein designated 604, is effected by a bridge 603 secured to the nozzle 602. The nozzle 602 is of generally the same construction as in FIGS. 15–17, including a body section 621 and a radially-extending wall section 622, both sections being formed with an axially-extending bore 625 whose outlet end is of enlarged diameter to define a socket 625*a* for accommodating the lower stem 642 of rotor 604. The underface of the rotor 604 is further formed with a pair of diametrically-opposed grooves 645, 646 which extend from the center of the rotor to its outer edge, and lower stem 642 is further formed with a pair of axially-extending grooves 647, 648 merging with grooves 645, 646.

Bridge 603 includes a vertically-extending leg 631 integrally formed with, or otherwise secured to, nozzle 602. Leg 631 is disposed laterally of rotor 604, and includes a horizontally-extending leg 632 overlying the upper end of the rotor. Leg 632 is formed with a recess 633 for rotatably receiving the upper stem 641 of the rotor. In addition, the upper portion of vertical leg 631 includes a section which decreases in thickness towards the rotor so as to form a shaped, pointed edge 634 which deflects the lateral jets impinging thereon to opposite sides of this leg.

It will be appreciated that the structure and operation of the sprinkler illustrated in FIGS. 18 and 19 are substantially the same as described above with respect to the sprinkler of FIGS. 15–17, except that the rotor 604 is completely exposed laterally of the sprinkler except for the vertical leg 631 of the bridge 603, which bridge permits rotary and axial movement of the rotor with respect to the nozzle bore 625.

Bridge 603 may take many different shapes and constructions. For example, it may be curved according to a circular or another curved configuration; it may be secure to the nozzle by a friction fit; and it may consist of two (or more) legs symmetrically disposed around the nozzle bore.

Many other variations, modifications, and applications of the invention will be apparent.

I claim:

1. A rotary sprinkler comprising a nozzle having an inlet end connectable to a source of pressurized water and formed with a central axial bore having an exit end through which the water exits in the form of an axial jet, a rotor in the path of said axial jet, and means for floatingly mounting said rotor for axial, lateral and rotary movements with respect to the nozzle bore, the underface of said rotor being formed with at least one groove extending from the rotor center to its outer edge for deflecting the jet laterally of the sprinkler and for imparting a rotary motion to the rotor; the exit end of said nozzle bore being of enlarged diameter to define a cylindrical socket; said rotor including a stem depending from its underface and floatingly received within said socket, and having an outer diameter smaller than the diameter of the socket for axial, lateral and rotary movements therein; said rotor stem being formed with at least one groove extending axially thereof and merging with said groove formed in the underface of the rotor, such that said stem movable within said socket decreases the divergence of the laterally-deflected jet, decreases the friction during the rotation of the rotor, and decreases the sensitivity of the sprinkler to clogging by particles in the water.

2. The sprinkler according to claim 1, wherein said stem is formed with two axially extending grooves on opposite sides thereof, each communicating with a groove formed in the underface of said rotor.

3. The sprinkler according to claim 1, wherein said means for floatingly mounting said rotor comprises a spindle received in the nozzle bore and passing through a bore formed centrally of said rotor.

4. The sprinkler according to claim 3, wherein said spindle is of longer length than said nozzle bore and is axially as well as laterally movable therein, said spindle including an inner stop engageable with said nozzle for limiting the outward movement of the spindle with respect to said nozzle bore, and an outer stop engageable with said rotor for limiting the outward movement of the rotor with respect to said spindle.

5. The sprinkler according to claim 3, wherein the face of said nozzle facing said rotor is formed with an annular rib around said bore; and the face of said rotor facing said nozzle is formed with an annular recess for receiving said annular rib, such that during the non-operation of the sprinkler, the outlet end of the nozzle bore is closed against the entry of foreign matter by said annular rib received in said recess.

6. The sprinkler according to claim 3, wherein said spindle is formed with a first section received within said nozzle bore, and with a second section, of large diameter than said first section, received within the bore in said rotor for floatingly mounting said rotor, the juncture between said two sections of the spindle being in substantial alignment with the juncture of said depending stem and said underface of the rotor during the normal operation of the sprinkler.

7. A sprinkler according to claim 1, wherein said means for floatingly mounting said rotor comprises a cap having a top wall and a peripheral side wall attached to said nozzle to define a chamber therewith, said cap being formed with a water outlet opening in its peripheral side wall, said rotor being freely disposed within said chamber with its depending stem received within said nozzle bore.

8. A sprinkler according to claim 7, wherein the upper face of said rotor is formed with an upper stem rotatably received within a recess formed centrally of said cap top wall.

9. A sprinkler according to claim 1, wherein said means for floatingly mounting said rotor comprises a bridge having one end secured to said nozzle and extending laterally of said rotor, the opposite end of said bridge being formed with a recess rotatably receiving a stem formed in the upper face of said rotor.

10. A rotary sprinkler comprising a nozzle having an inlet end connectable to a source of pressurized water and formed with a central axial bore having an exit end through which the water exits in the form of an axial jet, a rotor in the path of said axial jet, and a spindle for floatingly mounting said rotor for axial, lateral and rotary movements with respect to the nozzle bore, the underface of said rotor being formed with at least one groove extending from the rotor center to its outer edge for deflecting the jet laterally of the sprinkler and for imparting a rotary motion to the rotor; said spindle being received in the nozzle bore and passing through a bore formed centrally of said rotor; the exit end of said nozzle bore being of enlarged diameter to define a cylindrical socket; said rotor including a stem depending from its underface and floatingly received within said socket, and having an outer diameter smaller than the diameter of the socket for axial, lateral and rotary movements therein; said rotor stem being formed with at least one groove extending axially thereof and merging with said groove formed in the underface of the rotor, such that said stem movable within said socket decreases the divergence of the laterally-deflected jet, decreases the friction during the rotation of the rotor, and decreases the sensitivity of the sprinkler to clogging by particles in the water.

11. The sprinkler according to claim 10, wherein said stem is formed with two axially extending grooves on opposite sides thereof, each communicating with a groove formed in the underface of said rotor.

12. The sprinkler according to claim 10, wherein said spindle is of longer length than said nozzle bore and is axially as well as laterally movable therein, said spindle including an inner stop engageable with said nozzle for limiting the outward movement of the spindle with respect to said nozzle bore, and an outer stop engageable with said rotor for limiting the outward movement of the rotor with respect to said spindle.

13. The sprinkler according to claim 10, wherein the face of said nozzle facing said rotor is formed with an annular rib around said bore; and the face of said rotor facing said nozzle is formed with an annular recess for receiving said annular rib, such that during the non-operation of the sprinkler, the outlet end of the nozzle bore is closed against the entry of foreign matter by said annular rib received in said recess.

14. The sprinkler according to claim 10, wherein said spindle is formed with a first section received within said nozzle bore, and with a second section, of larger diameter than said first section, received within the bore in said rotor for floatingly mounting said rotor, the juncture between said two sections of the spindle being in substantial alignment with the juncture of said depending stem and said underface of the rotor during the normal operation of the sprinkler.

15. A rotary sprinkler comprising a nozzle having an inlet end connectable to a source of pressurized water and formed with a central axial bore having an exit end through which the water exits in the form of an axial jet, a rotor in the path of said axial jet, and means for floatingly mounting said rotor for axial, lateral and rotary movements with respect to the nozzle bore, the underface of said rotor being formed with a pair of grooves extending from the rotor center to its outer edge for deflecting the jet laterally of the sprinkler and for imparting a rotary motion to the rotor, said means for floatingly mounting said rotor comprising a cap having a top wall and a peripheral side wall attached to said nozzle to define a chamber therewith, said cap being formed with a water outlet opening in its peripheral side wall; the exit end of said nozzle bore being of enlarged diameter to define a cylindrical socket; said rotor including a stem depending from its underface and floatingly received within said socket, and having an outer diameter smaller than the diameter of said socket, for axial, lateral and rotary movement therein; said rotor stem being formed with a pair of grooves extending axially thereof and merging with said grooves formed in the underface of the rotor, such that said stem movable within said socket decreases the divergence of the laterally deflected jet, decreases the friction during the rotation of the rotor, and decreases the sensitivity of the sprinkler to clogging by particles in the water.

16. A sprinkler according to claim 15, wherein the upper face of said rotor is formed with an upper stem rotatably received within a recess formed centrally of said cap top wall.

* * * * *